US009528778B2

(12) United States Patent
Liu

(10) Patent No.: US 9,528,778 B2
(45) Date of Patent: Dec. 27, 2016

(54) REFRIGERANT GUIDING PIPE AND HEAT EXCHANGER HAVING REFRIGERANT GUIDING PIPE

(75) Inventor: Huazhao Liu, Hangzhou (CN)

(73) Assignees: SANHUA (HANGZHOU) MICRO CHANNEL HEAT EXCHANGER CO., LTD., Zhejiang Province (CN); DANFOSS A/S, Nordborg (DK)

( * ) Notice: Subject to any disclaimer, the term of this patent is extended or adjusted under 35 U.S.C. 154(b) by 97 days.

(21) Appl. No.: 13/822,612

(22) PCT Filed: Jun. 27, 2011

(86) PCT No.: PCT/CN2011/076419

§ 371 (c)(1),
(2), (4) Date: Apr. 10, 2013

(87) PCT Pub. No.: WO2012/034436

PCT Pub. Date: Mar. 22, 2012

(65) Prior Publication Data

US 2013/0192808 A1 Aug. 1, 2013

(30) Foreign Application Priority Data

Sep. 13, 2010 (CN) ..... 2010 1 0282890

(51) Int. Cl.
*F28F 9/02* (2006.01)
*F25B 39/00* (2006.01)
(Continued)

(52) U.S. Cl.
CPC ..... *F28F 9/0268* (2013.01); *F25B 39/00* (2013.01); *F28D 1/05316* (2013.01);
(Continued)

(58) Field of Classification Search
CPC ..... F28F 9/0263; F28F 9/0282; F28F 9/026; F28F 9/0265; F28F 9/0268; F28F 9/027; F28F 9/0273; F25B 39/028; F28D 1/05316
(Continued)

(56) References Cited

U.S. PATENT DOCUMENTS 2,488,615 A 11/1949 Arnold
3,229,761 A * 1/1966 Ware ..... 165/142
(Continued)

FOREIGN PATENT DOCUMENTS

CN 101482346 7/2009
CN 101691981 4/2010
(Continued)

OTHER PUBLICATIONS

International Search Report as issued for International Application No. PCT/CN2011/076419, dated Sep. 29, 2011.
(Continued)

*Primary Examiner* — Allen Flanigan
*Assistant Examiner* — Jason Thompson
(74) *Attorney, Agent, or Firm* — Pillsbury Winthrop Shaw Pittman LLP

(57) ABSTRACT

A refrigerant guiding pipe having a pipe wall in which an inner chamber is formed, an opening formed in the pipe wall, and a refrigerant guiding portion. At least a part of the refrigerant guiding portion is disposed to be substantially inclined with respect to an axial direction of the refrigerant guiding pipe to guide refrigerant passing through the opening. The refrigerant guiding pipe can distribute and guide refrigerant well to help avoid non-uniform distribution of refrigerant due to layering of gaseous refrigerant and liquid refrigerant.

18 Claims, 7 Drawing Sheets

(51) Int. Cl.
*F28D 1/053* (2006.01)
*F25B 39/02* (2006.01)

(52) U.S. Cl.
CPC ..... *F28F 9/0273* (2013.01); *F25B 39/028* (2013.01); *F25B 2500/01* (2013.01)

(58) Field of Classification Search
USPC ..... 165/174
See application file for complete search history.

(56) References Cited

U.S. PATENT DOCUMENTS

| | | | | |
|---|---|---|---|---|
| 4,335,782 | A | 6/1982 | Parker | |
| 5,860,595 | A | 1/1999 | Himmelsbach | |
| 6,199,401 | B1 | 3/2001 | Haussmann | |
| 6,729,386 | B1 * | 5/2004 | Sather | 165/110 |
| 6,796,374 | B2 | 9/2004 | Rong | |
| 6,863,121 | B2 | 3/2005 | Menon et al. | |
| 2002/0174978 | A1 | 11/2002 | Beddome et al. | |
| 2003/0094270 | A1 * | 5/2003 | Holm et al. | 165/166 |
| 2004/0026072 | A1 | 2/2004 | Yi et al. | |
| 2005/0126770 | A1 | 6/2005 | Higashiyama | |
| 2009/0236086 | A1 * | 9/2009 | Higashiyama et al. | 165/176 |
| 2010/0282454 | A1 | 11/2010 | Jiang et al. | |
| 2011/0139422 | A1 * | 6/2011 | Oddi et al. | 165/173 |
| 2013/0199764 | A1 | 8/2013 | Liu | |
| 2013/0213627 | A1 | 8/2013 | Liu | |

FOREIGN PATENT DOCUMENTS

| | | | | |
|---|---|---|---|---|
| CN | 101782297 | | 7/2010 | |
| CN | 101839590 | | 9/2010 | |
| CN | 101922882 | | 12/2010 | |
| CN | 101922883 | | 12/2010 | |
| CN | 101949663 | | 1/2011 | |
| JP | 2002-022313 | | 1/2002 | |
| WO | WO 2008048251 | A2 * | 4/2008 | F25B 39/028 |
| WO | WO 2012/034437 | | 3/2012 | |
| WO | WO 2012/034438 | | 3/2012 | |

OTHER PUBLICATIONS

International Search Report as issued for International Application No. PCT/CN2011/076423, dated Sep. 29, 2011.
International Search Report as issued for International Application No. PCT/CN2011/076428, dated Sep. 29, 2011.
Non-Final Office Action as issued in U.S. Appl. No. 13/822,616, dated Apr. 30, 2015.
Non-Final Office Action as issued in U.S. Appl. No. 13/822,609, dated Apr. 10, 2015.
U.S. Office Action dated Oct. 23, 2015 in corresponding U.S. Appl. No. 13/822,616.
U.S. Office Action dated Jan. 15, 2016 in corresponding U.S. Appl. No. 13/822,616.
U.S. Office Action dated Feb. 10, 2016 in corresponding U.S. Appl. No. 13/822,609.
U.S. Office Action dated May 13, 2016 in corresponding U.S. Appl. No. 13/822,609.
U.S. Office Action dated Nov. 2, 2016 in corresponding U.S. Appl. No. 13/822,609.

* cited by examiner

REFRIGERANT GUIDING PIPE AND HEAT EXCHANGER HAVING REFRIGERANT GUIDING PIPE

FIELD

The present invention relates to a refrigerant guiding pipe for a heat exchanger, particularly a distributor or collector for a heat exchanger, and a heat exchanger having the refrigerant guiding pipe.

BACKGROUND

In a typical heat exchanger, an inlet and/or outlet manifold of the heat exchanger may be provided with a refrigerant guiding pipe 100, and the refrigerant guiding pipe is used as a distributor in the inlet manifold and as a collector in the outlet manifold as shown in FIG. 7.

In the prior art, the refrigerant guiding pipe 100 comprises a plurality of substantially circular openings 111 arranged along a length of the refrigerant guiding pipe, and each of the openings has a center line 113 directed substantially in a radial direction of the refrigerant guiding pipe as shown in FIG. 7. The refrigerant guiding pipe has an axial direction perpendicular to the center line 113 of each of the openings.

SUMMARY

Therefore, in such a refrigerant guiding pipe 100, resistance to refrigerant jetted through the openings 111 is large, so a great pressure drop is generated and distribution of refrigerant is adversely affected.

It is desirable, for example, to provide a refrigerant guiding pipe and a heat exchanger with the refrigerant guiding pipe which can improve uniformity of refrigerant distribution.

According to an aspect of the present invention, there is provided a refrigerant guiding pipe. The refrigerant guiding pipe comprises a pipe wall in which an inner chamber is formed; an opening formed in the pipe wall; and a refrigerant guiding portion, at least a part of the refrigerant guiding portion is disposed to be substantially inclined with respect to an axial direction of the refrigerant guiding pipe to guide refrigerant passing through the opening.

According to another aspect of the present invention, there is provided a refrigerant guiding pipe for a heat exchanger. The refrigerant guiding pipe comprises a pipe wall, and a channel formed in the pipe wall, the channel having an inner wall, wherein at least a part of the inner wall of the channel is substantially inclined with respect to an axial direction of the refrigerant guiding pipe.

According to an aspect of the present invention, there is provided a heat exchanger with the refrigerant guiding pipe described herein.

With some embodiments of the refrigerant guiding pipe, refrigerant flows through the opening obliquely with respect to the axial direction of the refrigerant guiding pipe, thereby reducing resistance loss and improving uniformity of refrigerant distribution.

DETAILED DESCRIPTION

A further description of the invention will be made as below with reference to embodiments of the present invention taken in conjunction with the accompanying drawings.

Figure 1:
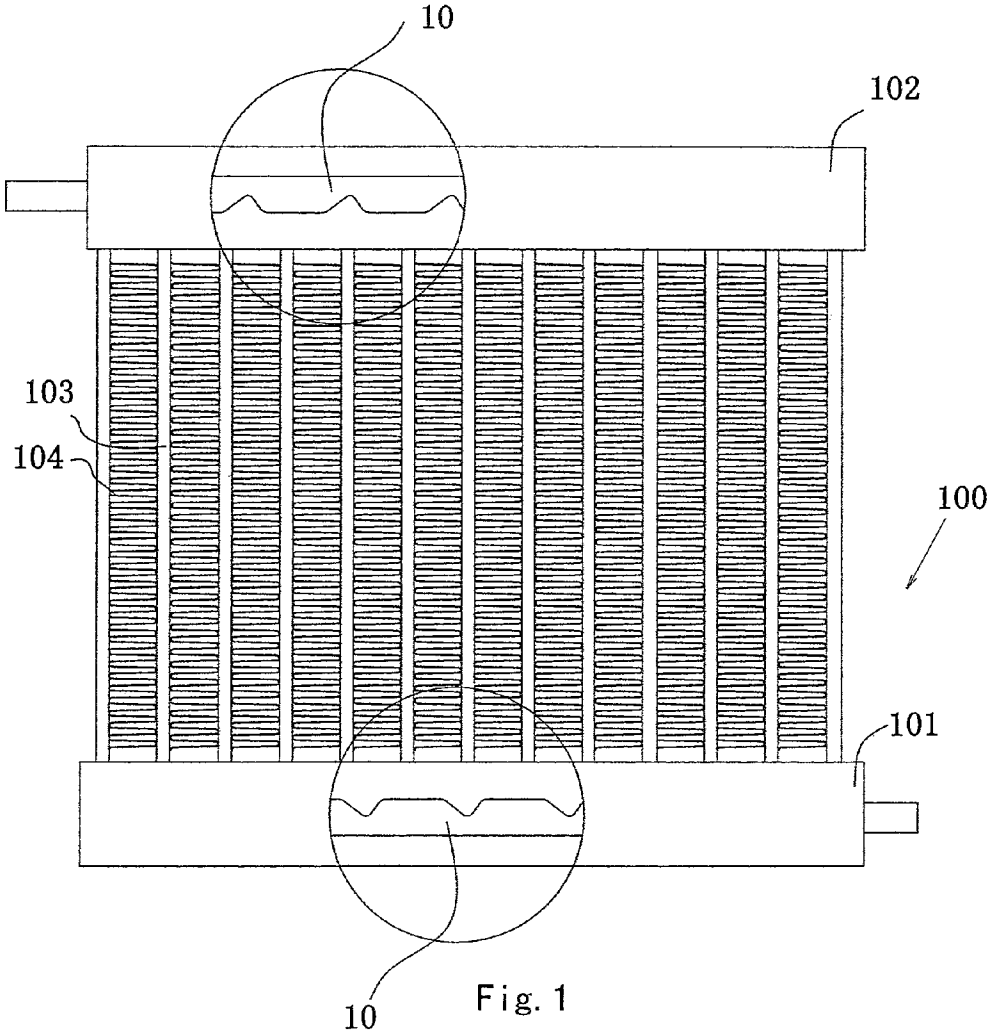
FIG. 1 is a schematic view of a heat exchanger according to an embodiment of the present invention.

As illustrated in FIG. 1, a heat exchanger 100 according to an embodiment comprises a first manifold 102; a second manifold 101 spaced away from the first manifold 102 by a predetermined distance; a heat exchange tube 103 such as a flat tube having two ends respectively connected with the first manifold 102 and the second manifold 101 so that a refrigerant channel in the heat exchange tube 103 is in communication with the first manifold 102 and the second manifold 101; a fin 104; and a refrigerant guiding pipe 10, the first manifold 102, or the second manifold 101, or both the first manifold 102 and the second manifold 101 being provided with the refrigerant guiding pipe 10 therein. The heat exchanger may be any appropriate heat exchanger such as a heat exchanger with one or more rows of cores or a heat exchanger with one or a plurality of loops. In addition, the heat exchanger may be a micro-channel heat exchanger. For example, the refrigerant guiding pipe may also be applied to an inner chamber part of an inlet manifold of a plurality of loops of the micro-channel heat exchanger and an inner chamber part of a manifold between the plurality of loops to guide and distribute refrigerant such as two-phase refrigerant.

Figure 2A:
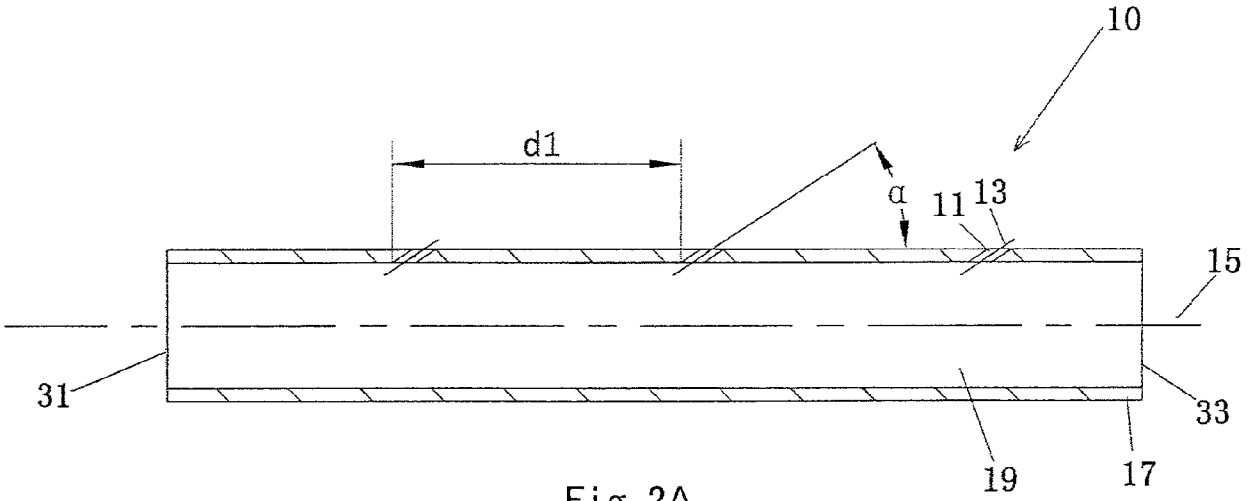
FIG. 2A is a schematic view of a refrigerant guiding pipe according to an embodiment of the present invention.
Figure 2B:
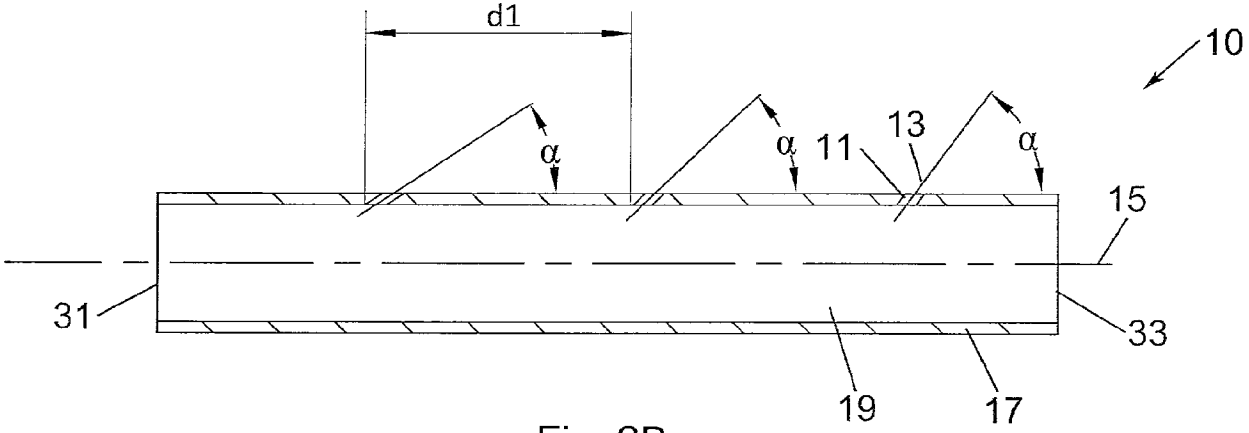
FIG. 2B is a schematic view of a refrigerant guiding pipe according to an embodiment of the present invention.
Figure 2C:
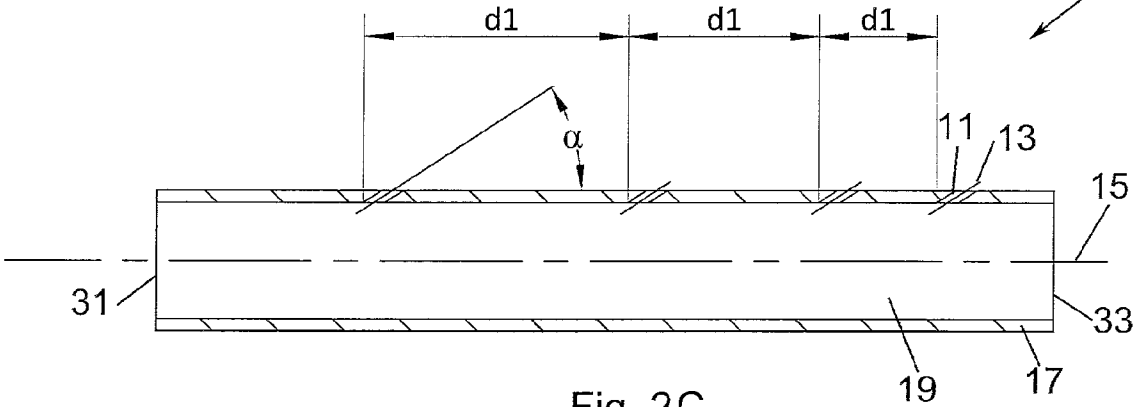
FIG. 2C is a schematic view of a refrigerant guiding pipe according to an embodiment of the present invention.
Figure 4:
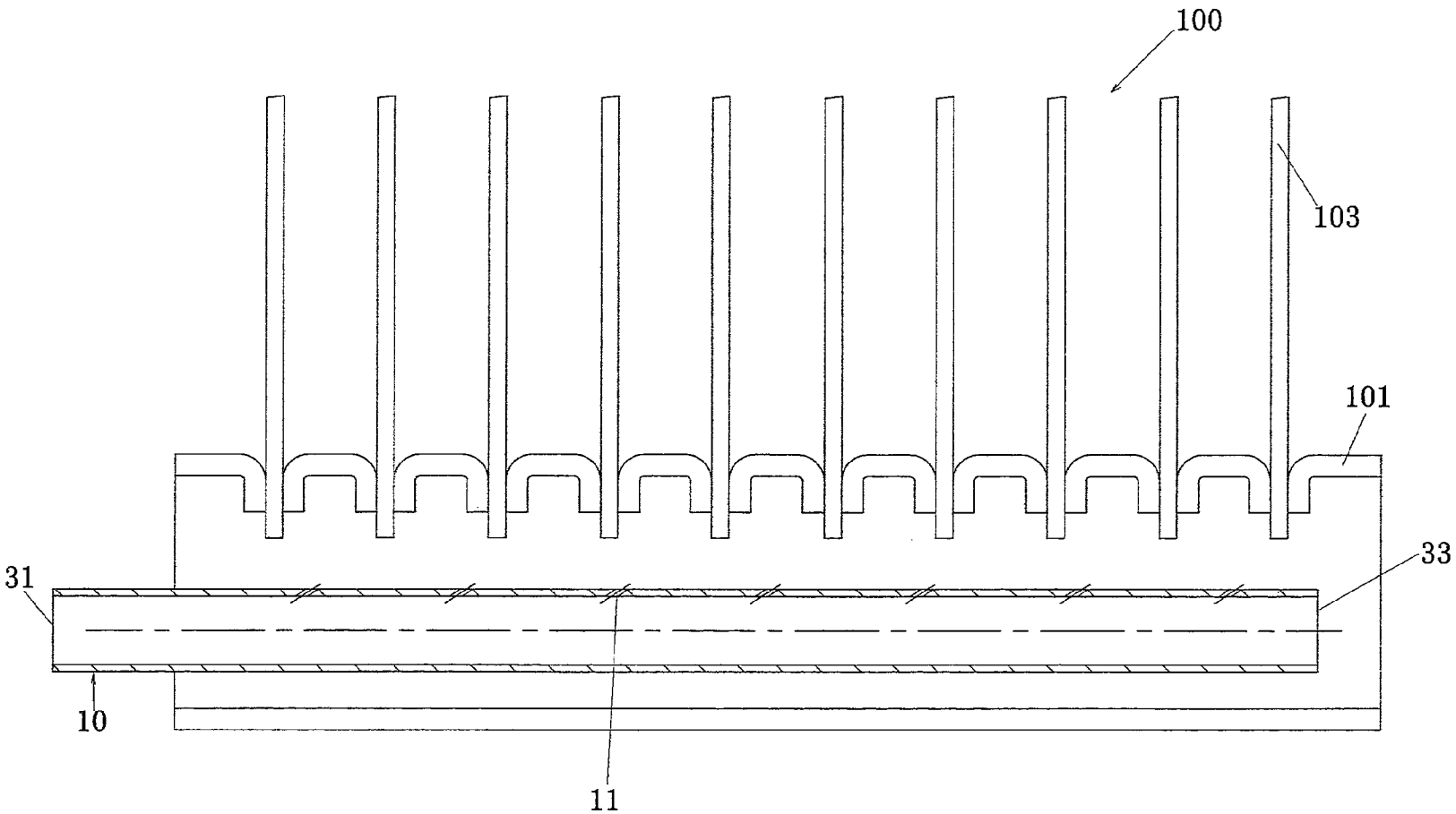
FIG. 4 is a partially enlarged schematic view of a heat exchanger according to an embodiment of the present invention.
Figure 5:
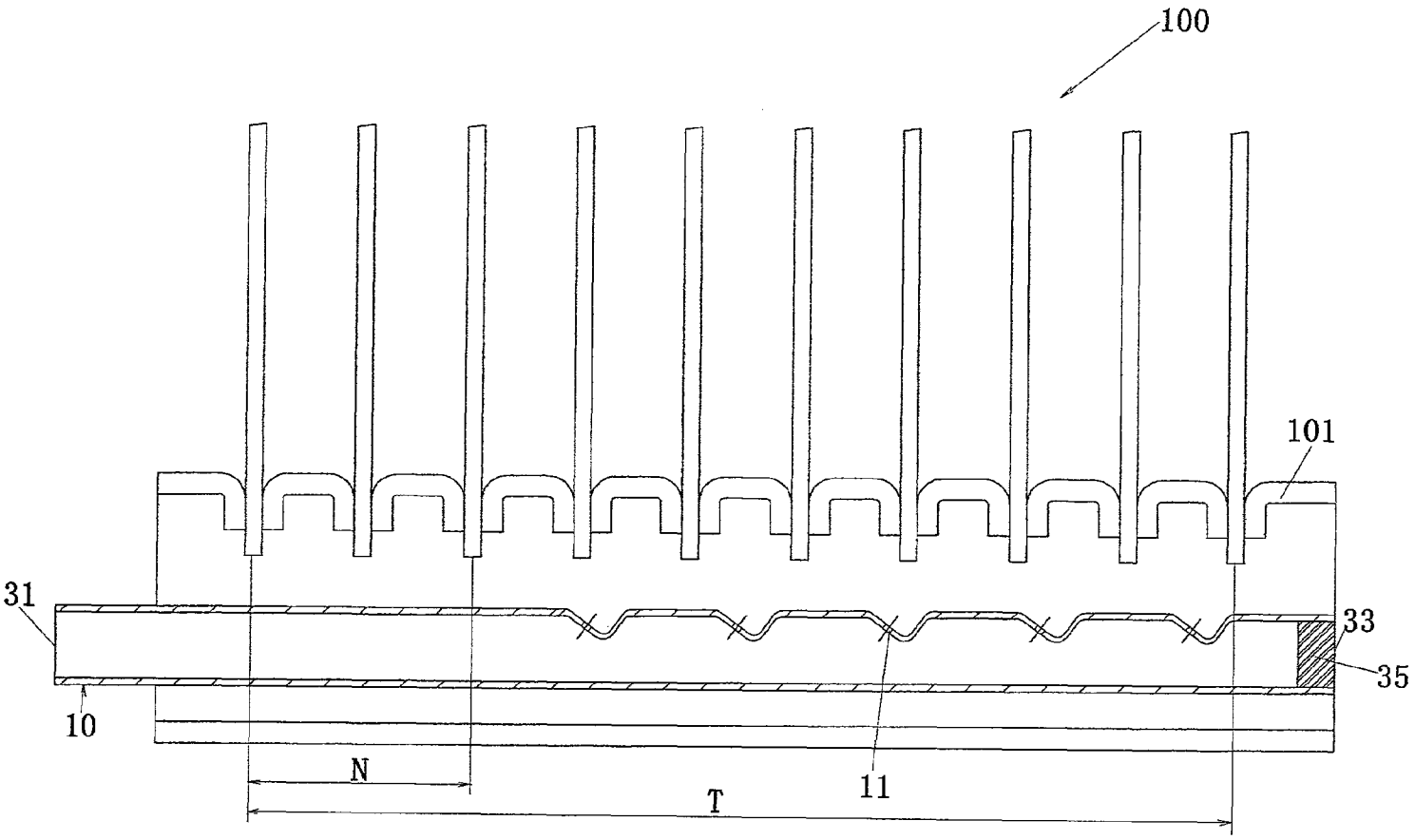
FIG. 5 is a partially enlarged schematic view of a heat exchanger according to an embodiment of the present invention.

FIGS. 2A-2C show a refrigerant guiding pipe 10 according to an embodiment. As illustrated in FIGS. 2A-2C, the refrigerant guiding pipe 10 comprises: a pipe wall 17 in which an inner chamber 19 is formed; an opening 11 formed in the pipe wall; and a refrigerant guiding portion, at least a part of the refrigerant guiding portion is disposed to be substantially inclined with respect to an axial direction of the refrigerant guiding pipe to guide refrigerant passing through the opening 11. The refrigerant guiding portion is disposed so that a direction of refrigerant flow flowing through the opening 11 is substantially inclined with respect to the axial direction of the refrigerant guiding pipe 10. For example, the refrigerant guiding portion is disposed such that refrigerant flow flowing through the opening 11 is inclined with respect to the axial direction of the refrigerant guiding pipe by an angle of more than about zero degree and less than about 90 degrees, desirably from about 5 degrees to about 75 degrees. Referring to FIGS. 4 and 5, the refrigerant guiding pipe 10 has an open end and another end which may be closed or open.

When the refrigerant guiding pipe 10 serves as a distributor, the distance or pitch d1 between the adjacent openings 11 may gradually decrease in a direction in which refrigerant flows in the refrigerant guiding pipe 10. Alternatively, the plurality of openings 11 may have the same pitch d1.

The refrigerant guiding pipe 10 with the above configuration may also serve as a collector in the outlet manifold 102.

Referring to FIGS. 4 and 5, no matter that the refrigerant guiding pipe 10 serves as a distributor in the inlet manifold 101 or as a collector in the outlet manifold 102, an end 31 of the refrigerant guiding pipe 10 will be connected to refrigerant piping but another end 33 will not be connected to the refrigerant piping. Therefore, the refrigerant guiding pipe 10 may be designed such that the pitch d1 of the openings 11 may gradually decrease in a direction ranging from the end 31 of the refrigerant guiding pipe 10 to be connected to a refrigerant piping to the other opposite end 33 of the refrigerant guiding pipe 10, that is, from the end 31 to the other end 33. Alternatively, the end 33 of the refrigerant guiding pipe 10 will be connected to refrigerant piping but the end 31 will not be connected to the refrigerant piping.

A row of the openings 11 or a plurality of rows of the openings 11 such as two or three rows of the openings 11 may be disposed along the axial direction of the refrigerant guiding pipe 10. The openings 11 may be arranged substantially along a straight line, or the openings 11 may be arranged in any other appropriate manner. For example, the openings 11 may be arranged along a curve, a helix or the like.

In the above examples, the refrigerant guiding pipe 10 is formed with a pipe having a circular cross-section. The refrigerant guiding pipe 10 may also be formed of a pipe having any other cross section such as an elliptical or rectangular cross section. In addition, the refrigerant guiding pipe 10 may be formed of a pipe having a varying radius or width. The refrigerant guiding pipe 10 may be formed of any appropriate pipe known in the art.

A cross sectional area of the opening 11 may be in a range of 0.2-130 $mm^2$. The distance or pitch d1 between the adjacent openings may be in a range more than or equal to 10 mm and less than or equal to 280 mm.

Referring to FIGS. 1, 4 and 5, when the above refrigerant guiding pipe 10 is used in the manifold 101 of the heat exchanger 100, refrigerant flows along the inner chamber of the refrigerant guiding pipe, and the inclined opening 11 functions to guide the refrigerant. The refrigerant is ejected to an inner cavity of the manifold along the inclined opening 11 so that resistance loss is low. A part of the refrigerant can be ejected directly into inner chambers of flat tubes 103 and the remaining refrigerant rushes to an end of the manifold 101 and then flows reversely so that refrigerant is uniformly distributed to the remaining flat tubes 103. Refrigerant is mixed in the manifold 101 so that gaseous refrigerant and liquid refrigerant are uniformly mixed and layering of the refrigerant is inhibited.

As illustrated in FIGS. 2A-2C, the opening 11 is a channel formed in the pipe wall 17. An axis 13 of the channel is inclined with respect to the axial direction of the refrigerant guiding pipe 10. An inner wall of the channel forms an example of the refrigerant guiding portion. The axis 13 of the channel is inclined with respect to the axial direction of the refrigerant guiding pipe 10 by an angle $\alpha$ of more than zero degree and less than 90 degrees, desirably from about 5 degrees to about 75 degrees.

In some embodiments, at least a part of the inner wall of the channel is positioned at an angle of more than zero degree and less than 90 degrees, desirably from about 5 degrees to about 75 degrees, with respect to the axial direction of the refrigerant guiding pipe.

Referring to FIGS. 4 and 5, the refrigerant guiding pipe 10 may be designed such that the above angles $\alpha$ may gradually increase in the direction directed from the end 31 of the refrigerant guiding pipe 10 to be connected to refrigerant piping to the other opposite end 33 of the refrigerant guiding pipe 10. In other words, the angle $\alpha$ between the axis 13 of the channel and the axial direction of the refrigerant guiding pipe 10 may gradually increase from the end 31 to the other end 33.

The channel may have a substantially circular cross section. The entire inner wall of the channel may be inclined. Alternatively, the cross section of the channel may have other shapes. For example, at least a part of the inner wall of the channel is inclined to serve as the refrigerant guiding portion. For example, only a portion of the inner wall of the channel on the end 31 side is inclined.

Figure 3:
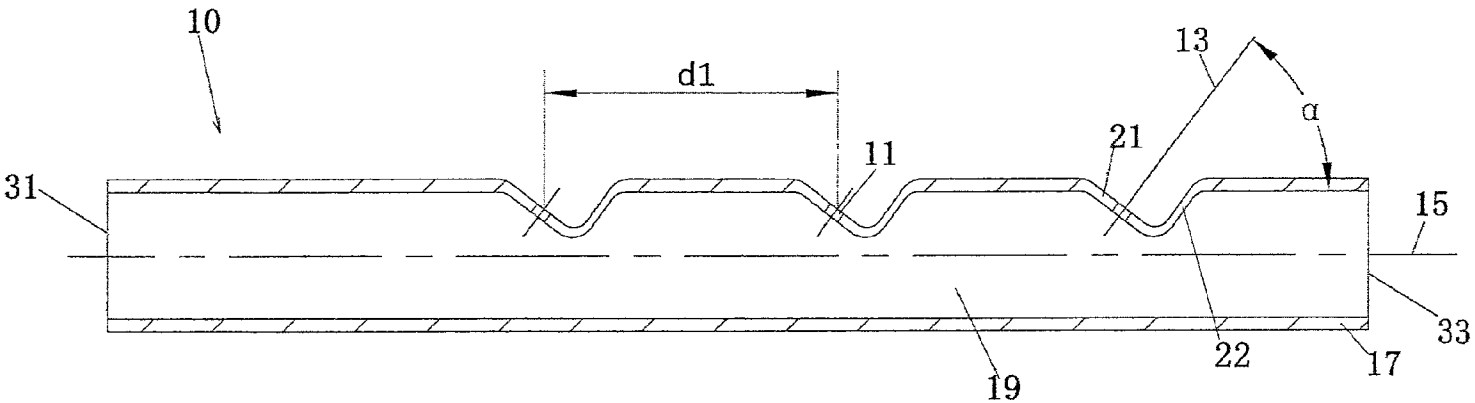
FIG. 3 is a schematic view of a refrigerant guiding pipe according to an embodiment of the present invention.

FIG. 3 shows a refrigerant guiding pipe 10 according to an embodiment. A refrigerant guiding pipe 10 according to this embodiment may be the same as the refrigerant guiding pipe 10 according to the embodiment of FIGS. 2A-2C except as described hereafter. As illustrated in FIG. 3, the opening 11 is a channel formed in the pipe wall 17. An axis 13 of the channel is inclined with respect to the axial direction of the refrigerant guiding pipe 10. An inner wall of the channel forms an example of the refrigerant guiding portion. The axis 13 of the channel is inclined with respect to the axial direction of the refrigerant guiding pipe 10 by an angle $\alpha$ of more than about zero degree and less than 90 degrees, desirably from 5 degrees to 75 degrees. In addition, the refrigerant guiding pipe 10 comprises an inclined wall portion 21. The inclined wall portion 21 as a portion of the pipe wall 17 is inclined with respect to the axial direction of the refrigerant guiding pipe 10. The opening 11 is formed in the inclined wall portion 21.

The refrigerant guiding pipe 10 may further comprise an inclined wall portion 22. The inclined wall portion 22 may form a refrigerant guiding portion by disposing a portion of the inner wall of the channel of the opening 11 near the inclined wall portion 22.

Figure 6:
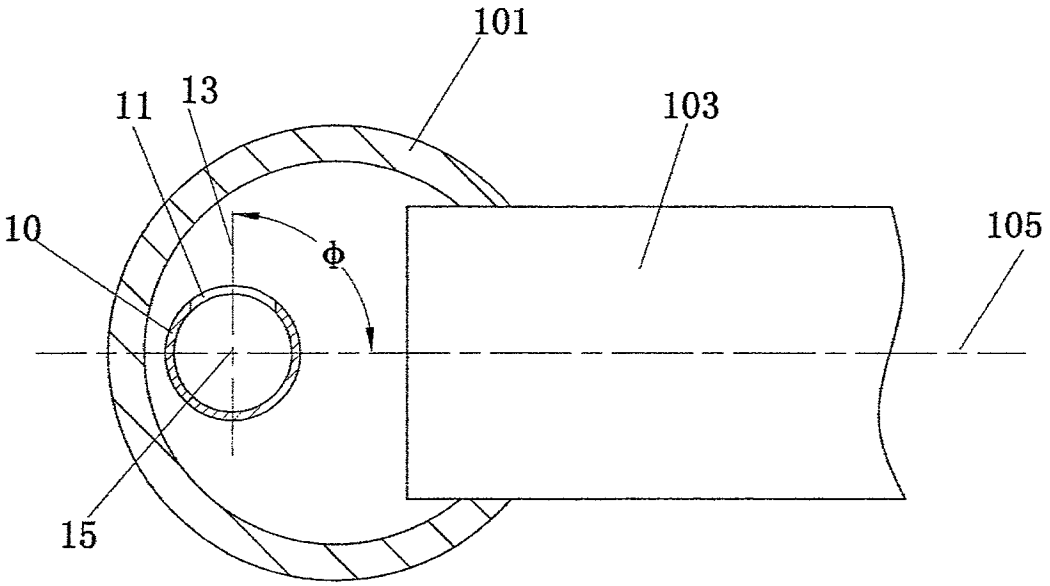
FIG. 6 is a partially enlarged schematic view of a heat exchanger according to an embodiment of the present invention.
Figure 7:
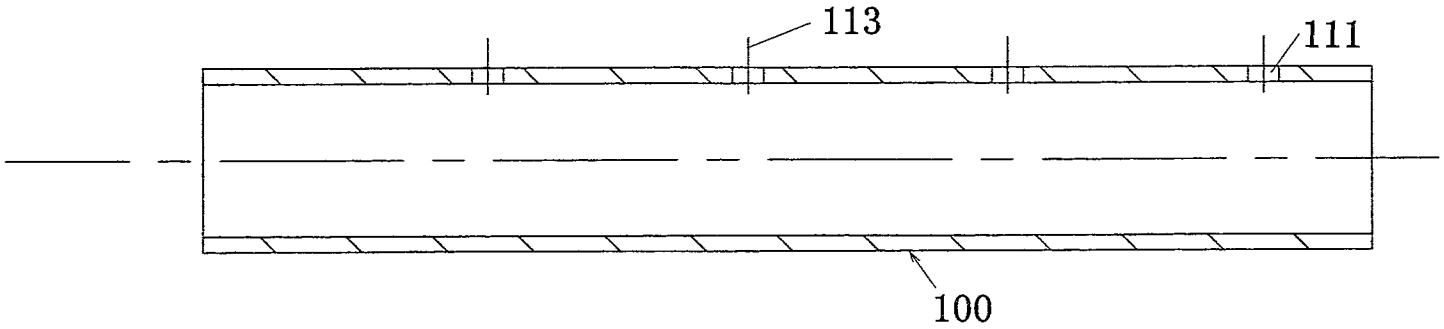
FIG. 7 is a schematic view of a conventional refrigerant guiding pipe.

A heat exchanger 100 according to an embodiment will be described below in detail. FIGS. 4, 5, and 6 are partially enlarged schematic views of the heat exchanger 100 according to an embodiment.

Referring to FIG. 5, in a region along an axial direction of the manifold 101 where the heat exchange tubes 103 such as flat tubes are disposed, the refrigerant guiding pipe 10 may be provided with the openings 11.

As illustrated in FIG. 5, for example, when the refrigerant guiding pipe 10 serves as a distributor in the inlet manifold 101, the refrigerant guiding pipe 10 is not provided with the opening 11 in a non-opening range from an end 31 of the refrigerant guiding pipe 10 to a position spaced away from the end 31 in a direction directed from the inlet-side end 31 of the refrigerant guiding pipe 10 to another end 33 of the refrigerant guiding pipe 10. A number of the heat exchange tubes 103 such as flat tubes in the non-opening range is N, a number of the heat exchange tubes 103 over a range corresponding to all of the heat exchange tubes 103 is T, and a ratio of the number N to the number T is more than 20% and less than 99%. With the above ratio, a good refrigerant distribution effect can be achieved. Experiments show that when the ratio is more than 95% and less than 99%, a remarkably notable effect of uniformly distributing refrigerant can be obtained. The refrigerant guiding pipe 10 with the above configuration may also serve as a collector in the outlet manifold 102 to achieve an effect of uniformly distributing refrigerant.

As illustrated in FIG. 4, the refrigerant guiding pipe 10 may be provided with the openings 11 over the range corresponding to all of the heat exchange tubes 103.

No matter that the refrigerant guiding pipe 10 serves as a distributor in the inlet manifold 101 or as a collector in the outlet manifold 102, the end 31 of the refrigerant guiding pipe 10 will be connected to refrigerant piping but the other end 33 will not be connected to the refrigerant piping. Therefore, the refrigerant guiding pipe 10 may be designed in such a way that the number of the heat exchange tubes 103, such as flat tubes, is N in the non-opening range from the end 31 of the refrigerant guiding pipe 10 to be connected with refrigerant piping to a position spaced away from the end 31 by a predetermined distance, that the number of the heat exchange tubes 103 over a range of the refrigerant guiding pipe 10 corresponding to all of the heat exchange tubes 103 is T, and a ratio of the number N to the number T is more than about 20% and less than about 99%, desirably more than about 95% and less than about 99%.

As illustrated in FIG. 5, the other end 33 of the refrigerant guiding pipe 10 may be sealed by means of an element 35. Alternatively, as illustrated in FIG. 4, the element 35 may not be disposed, and the other end 33 of the refrigerant guiding pipe 10 is open, thereby obtaining a very notable effect of uniformly distributing refrigerant. The refrigerant guiding pipe 10 with the above configuration may also serve as a collector in the outlet manifold 102 to achieve an effect of uniformly distributing refrigerant.

When the refrigerant guiding pipe 10 is used as a distributor, two-phase refrigerant in the refrigerant guiding pipe 10 is ejected from the openings 11, a part of the two-phase refrigerant enters directly into inner chambers of the heat exchange tubes 103 such as flat tubes, and the remaining refrigerant rushes to an end of the manifold 101 and then flows reversely to be distributed to the heat exchange tubes 103 such as flat tubes uniformly.

As illustrated in FIG. 6, the refrigerant guiding pipe 10 and the heat exchange tubes 103 are opposite to each other, or a center line 15 of the refrigerant guiding pipe 10 intersects elongation lines of axes 105 of the heat exchange tubes 103 such as flat tubes. Of course, the refrigerant guiding pipe 10 and the heat exchange tubes 103 may be positioned in any appropriate relative positions. The axis 13 of the channel is positioned at an angle $\phi$ of from 0 to 90 degrees with respect to a longitudinal direction of the heat exchange tube 103 (or an axis 105 of the heat exchange tube 103), thereby obtaining a good refrigerant distribution effect.

In the above embodiments, refrigerant flows along the inner chamber of the refrigerant guiding pipe, and the refrigerant guiding portion mainly functions to guide the refrigerant. The refrigerant is ejected to an inner cavity of the manifold along the refrigerant guiding portion so that resistance loss is low. A part of refrigerant can be ejected directly into inner chambers of the heat exchange tubes and the remaining refrigerant rushes to an end of the manifold and then flows reversely to be uniformly distributed to the remaining heat exchange tubes. Refrigerant is mixed in the manifold so that gaseous refrigerant and liquid refrigerant are uniformly mixed and layering of the refrigerant is inhibited.

The channel as the refrigerant guiding portion has been described in the above embodiments, but the present invention is not limited to the above embodiments. For example, the refrigerant guiding portion may be any appropriate member for guiding refrigerant or changing a direction of refrigerant. The member may be separately formed and connected to an inner side or outer side or the refrigerant guiding pipe, or may be integrally formed with the refrigerant guiding pipe.

The structures described in the above embodiments may be appropriately combined to form new embodiments. Features in one embodiment may also be applicable to the other embodiments or substitute for those of the other embodiments.

What is claimed is:

1. A refrigerant guiding pipe for a heat exchanger, the refrigerant guiding pipe comprising:

a pipe wall in which an inner chamber is formed;

a recess in the pipe wall that is depressed inwardly, the recess having first and second inclined wall portions as portions of the pipe wall, the first inclined wall portion being inclined in a first direction with respect to an axial direction of the refrigerant guiding pipe and the second inclined wall portion being inclined in a second direction different from the first direction with respect to the axial direction of the refrigerant guiding pipe; and a channel in the pipe wall of the recess, wherein the first and second inclined wall portions are opposite each other across the recess and the channel is in the first inclined wall portion.

2. The refrigerant guiding pipe of claim 1, wherein an axis of the channel is inclined with respect to the axial direction of the refrigerant guiding pipe.

3. The refrigerant guiding pipe of claim 1, further comprising a plurality of channels in the pipe wall and wherein angles between axes of the channels and the axial direction of the refrigerant guiding pipe gradually increase in a direction from a first end of the refrigerant guiding pipe toward a second end of the refrigerant guiding pipe.

4. The refrigerant guiding pipe of claim 1, comprising a first end of the refrigerant guiding pipe to be connected with refrigerant piping, and a second end of the refrigerant guiding pipe opposite to the first end, wherein the second end of the refrigerant guiding pipe is open in use.

5. The refrigerant guiding pipe of claim 1, further comprising:

channels formed in the pipe wall; and a first end of the refrigerant guiding pipe to be connected with refrigerant piping, and a second end of the refrigerant guiding pipe opposite to the first end, wherein pitches of the channels gradually decrease in a direction from the first end of the refrigerant guiding pipe toward the second end of the refrigerant guiding pipe.

6. The refrigerant guiding pipe of claim 5, wherein an axis of each of the channels is inclined with respect to the axial direction of the refrigerant guiding pipe.

7. The refrigerant guiding pipe of claim 5, wherein angles between axes of the channels and the axial direction of the refrigerant guiding pipe gradually increase in a direction from the first end of the refrigerant guiding pipe toward the second end of the refrigerant guiding pipe.

8. A heat exchanger, comprising:

a first manifold;

a second manifold spaced away from the first manifold by a certain distance;

a heat exchange tube having two ends respectively connected with the first manifold and the second manifold; and a refrigerant guiding pipe, comprising:

a pipe wall in which an inner chamber is formed, a recess in the pipe wall that is depressed inwardly, the recess having first and second inclined wall portions as portions of the pipe wall, the first inclined wall portion being inclined in a first direction with respect to an axial direction of the refrigerant guiding pipe and the second inclined wall portion being inclined in a second direction different from the first direction with respect to the axial direction of the refrigerant guiding pipe, a channel in the pipe wall of the recess, wherein the first and second inclined wall portions are opposite each other across the recess and the channel is in the first inclined wall portion, and a first end of the refrigerant guiding pipe to be connected with refrigerant piping, and a second end of the refrigerant guiding pipe opposite to the first end.

9. The heat exchanger of claim 8, wherein the refrigerant guiding pipe further comprises:

a non-opening range across from the first end of the refrigerant guiding pipe to a position spaced away from the first end of the refrigerant guiding pipe by a certain distance, wherein a ratio of a number of the heat exchange tubes in the non-opening range to a number of all of the heat exchange tubes corresponding to the refrigerant guiding pipe is more than about 20% and less than about 99%.

10. The heat exchanger of claim 8, wherein the refrigerant guiding pipe further comprises:

channels formed in the pipe wall, wherein pitches of the channels gradually decrease in a direction from the first end of the refrigerant guiding pipe toward the second end of the refrigerant guiding pipe, and wherein the first manifold and/or the second manifold has the refrigerant guiding pipe therein.

11. The heat exchanger of claim 10, wherein the refrigerant guiding pipe further comprises:

a non-opening range across from the first end of the refrigerant guiding pipe to a position spaced away from the first end of the refrigerant guiding pipe by a certain distance, wherein a ratio of a number of the heat exchange tubes in the non-opening range to a number of all of the heat exchange tubes corresponding to the refrigerant guiding pipe is more than about 20% and less than about 99%.

12. The heat exchanger of claim 10, wherein angles between axes of the channels and the axial direction of the refrigerant guiding pipe gradually increase in a direction from the first end of the refrigerant guiding pipe toward the second end of the refrigerant guiding pipe.

13. The heat exchanger of claim 8, comprising a plurality of channels in the pipe wall and wherein angles between axes of the channels and the axial direction of the refrigerant guiding pipe gradually increase in a direction from the first end of the refrigerant guiding pipe toward the second end of the refrigerant guiding pipe.

14. The heat exchanger of claim 8, wherein the first manifold and/or the second manifold has the refrigerant guiding pipe therein.

15. The heat exchanger of claim 8, wherein an axis of the channel is inclined with respect to the axial direction of the refrigerant guiding pipe.

16. The heat exchanger of claim 8, wherein the second end of the refrigerant guiding pipe is open in use.

17. The heat exchanger of claim 8, wherein an axis of the channel is inclined with respect to the flow direction of refrigerant in the refrigerant guiding pipe by an angle of more than zero degrees and less than 90 degrees.

18. The refrigerant guiding pipe of claim 1, further comprising a plurality of channels in the pipe wall and wherein an axis of each of the channels is inclined with respect to the axial direction of the refrigerant guiding pipe.

* * * * *